United States Patent [19]

Higuchi et al.

[11] Patent Number: 4,820,617

[45] Date of Patent: Apr. 11, 1989

[54] HEAT-DEVELOPABLE PHOTOSENSITIVE MATERIAL

[75] Inventors: Tetuya Higuchi; Akira Tsukada; Yukio Takegawa, all of Tokyo, Japan

[73] Assignee: Oriental Photo Industrial Co., Ltd., Tokyo, Japan

[21] Appl. No.: 142,285

[22] Filed: Dec. 30, 1987

Related U.S. Application Data

[63] Continuation of Ser. No. 857,410, Apr. 28, 1986, abandoned, which is a continuation of Ser. No. 618,606, Jun. 8, 1984, abandoned.

[51] Int. Cl.[4] ..... G03C 1/34

[52] U.S. Cl. ..... 430/570; 430/607; 430/619; 430/620; 430/608; 430/353

[58] Field of Search ..... 430/607, 618, 619, 620, 430/570, 608, 965, 353

[56] References Cited

U.S. PATENT DOCUMENTS

| | | | |
|---|---|---|---|
| 3,589,903 | 6/1971 | Birkeland | 430/619 |
| 3,645,739 | 2/1972 | Ohkubo et al. | 430/619 |
| 3,816,132 | 6/1974 | Takegawa et al. | 430/620 |
| 4,258,129 | 3/1981 | Ikenoue et al. | 430/620 |
| 4,273,845 | 6/1981 | Kobayashi et al. | 430/620 |

FOREIGN PATENT DOCUMENTS 1173426 12/1969 United Kingdom .

*Primary Examiner*—Won H. Louie

*Attorney, Agent, or Firm*—Flynn, Thiel, Boutell & Tanis

[57] ABSTRACT

A heat-developable photosensitive material of which thermal fogging is markedly suppressed without detriment to image characteristics such as sensitivity, which is prepared by forming a single layer or multiple layers of a heat-developable photosensitive element comprising at least (a) an oxidation-reduction image-forming component comprising a long-chain fatty acid silver salt and a reducing agent, (b) a photosensitive silver halide or/and a photosensitive slilver halide-forming component, (c) a binder, and (d) at least one member selected from the compounds represented by the following general formula:

HOOC—R—COOH wherein R represents an alkylene or alkenylene group of at least 4 carbon atoms which may be linear or branched, on a support.

11 Claims, No Drawings

HEAT-DEVELOPABLE PHOTOSENSITIVE MATERIAL

This application is a continuation of U.S. Ser. No. 857,410, filed Apr. 28, 1986, now abandoned, which is a continuation of U.S. Ser. No. 618,606, filed June 8, 1984, now abandoned.

BACKGROUND OF THE INVENTION

1. Field of the Invention

This invention relates to a heat-developable photosensitive material, and more particularly to a heat-developable photosensitive material whose thermal fogging during development is markedly reduced without detriment to image characteristics, such as sensitivity loss, by adding an aliphatic dicarboxylic acid having at least four carbon atoms.

2. Description of the Prior Art

Although conventional silver halide photography is excellent in photosensitivity, gradient and the like, as compared with other photographies, its handling is complicated and it is unfavorable for the mechanization of processing steps in many respects because its processing steps such as fixation and bleaching ae of wet process. A number of attempts have been made to form an image by using a dry process instead of the silver halide photography. A process for forming an image by using a heat-developable photosensitive material was proposed as the one which was particulrly excellent as compared with the conventional image formation processes.

For example, Japanese Patent Publication No. 4924/1968 described a heat-developable photosensitive material comprising a silver halide in catalytic contact with an organosilver salt. Similar materials were described in Japanese Patent Publication No. 26582/1969 and Japanese Patent Laid-Open No. 6074/1971. In addition, there have been proposed heat-developable photosensitive materials which are used in such a way that they are activated and rendered photosensitive by a heat treatment before exposure and they are totally heated in order to form images after exposure, and processes for preparing the same. These heat-developable photosensitive materials comprise a heat-developable photosensitive element either containing no silver halide or containing silver halide but having no photosensitivity, as described in Japanese Patent Publication Nos. 29819/1976, 41967/1978 and 5687/1979.

Although the heat-developable photosensitive materials have an advantage that their image formation can be performed without resort to a wet process, their image characteristics such as sensitivity and fog density can not be though to be sufficient yet as compared with those of the conventional silver halide photography. Particularly, thermal fogging is prone to occur at the unexposed area (background area) during heat development, so that the latitudes of a development temperature and a development time become a great practical problem. In order to control an increase in the thermal fogging, a variety of processes have been proposed. Japanese Patent Publication No. 11113/1972 proposed the addition of mercury compounds as a thermal fogging preventive. Although this process can provide an excellent thermal fogging preventing effect, it is not preferable because of the toxicity of the compound. Moreover, there is a drawback that an unexposed photographic material loses its sensitivity during storage. In addition to the mercury compounds, a variety of antifoggants are proposed. For example, Japanese Patent Laid-Open No. 54428/1976 proposed the use of a combination of sulphinic acids with phthalic acids, but this process is not desirable because it has a problem that coloration occurs by light after the image formation. Moreover, processes were proposed which comprises a variety of compounds, such as thiouracils in Japanese Patent Laid-Open No. 3223/1976, carboxyl group- or sulfonic group-containing polymer acids in Japanese Patent Laid-Open No. 104338/1976, thiosulfonic acids in Japanese Patent Publication No. 44212/1979, or benzoic acids in Japanese Patent Laid-Open No. 125015/1978, but none of these processes could provide an antifogging effect which was superior to that of the mercury compounds which were undesirable because of their toxicity.

SUMMARY OF THE INVENTION

It is an object of this invention to provide a heat-developable photosensitive material whose thermal fogging during development is markedly suppressed, and which is freed from changes in image characteristics, such as sensitivity loss, is excellent in long-term stability and is stable to light after image formation.

This object of the present invention can be achieved by adding at least one member selected from the compounds represented by the following general formula:

HOOC—R—COOH wherein R represents an alkylene or alkenylene group of at least four carbon atoms which may be linear or branched.

to a heat-developable photosensitive element prepared by forming a monolayer or multilayer of a heat-developable photosensitive element comprising at least (a) an oxidation-reduction image-forming component comprising a long-chain fatty acid silver salt and a reducing agent, (b) a photosensitive silver halide or/and a photosensitive silver halide-forming component, and (c) a binder on a support.

It was surprising also to the invention of this invention that when the long-chain fatty acid silver salt is used as a reducible organosilver salt, a prominent antifogging effect can be obtained, though the reaction mechanism whereby the compound of this invention can suppress the thermal fogging is not clear, considering that it does not cause adverse influences such as desensitization and loss of stability with the lapse of time. Although, as mentioned above, a variety of proposals were made for obtaining an antifogging effect by using a carboxylic group-containing compound as an antifoggant, the compound according to this invention is quite different from such compounds in its effect and, for example, the effect of an aliphatic monocarboxylic acid as an antifoggant is weak as compared with that of the compound of this invention. In Japanese Patent Publication No. 12700/1970, use is made of, as heat development accelerating agents when silver-benzotriazole is used as a reducible silver salt, organic acids such as saturated aliphatic monocarboxylic acids of 9 to 26 carbon atoms, aliphatic dicarboxylic acids of 4 to 10 carbon atoms, and hydroxy group-substituted benzoic acid compounds and salts of these organic acids. Although the difference in the effect of adding aliphatic dicarboxylic acids between said invention and the present invention is not clear, it might be thought, if any, to be a difference in the reducibilities between the silver-benzotriazole and the long-chain fatty acid silver salt as reducible organosilver salts.

DETAILED DESCRIPTION OF THE PREFERRED EMBODIMENTS

Examples of the compounds according to this invention are as follows, though they should not be limited thereto, of course.

$HOOC(CH_2)_4COOH$ (1)

$HOOC(CH_2)_5COOH$ (2)

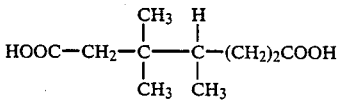
(3)

$HOOC(CH_2)_6COOH$ (4)

$HOOC(CH_2)_7COOH$ (5)

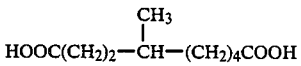
(6)

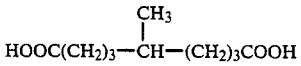
(7)

$HOOC(CH_2)_8COOH$ (8)

$HOOC-CH=CH-(CH_2)_6COOH$ (9)

$HOOC(CH_2)_9COOH$ (10)

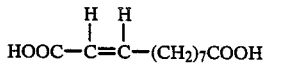
(11)

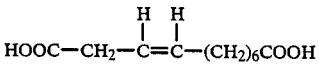
(12)

$HOOC(CH_2)_{10}COOH$ (13)

$HOOC-CH=CH-(CH_2)_8COOH$ (14)

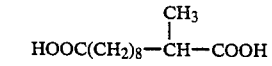
(15)

$HOOC(CH_2)_{11}COOH$ (16)

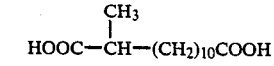
(17)

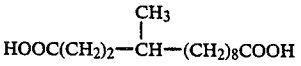
(18)

$HOOC(CH_2)_{12}COOH$ (19)

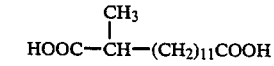
(20)

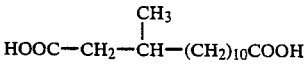
(21)

$HOOC(CH_2)_{13}COOH$ (22)

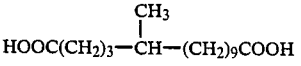
(23)

$HOOC(CH_2)_{14}COOH$ (24)

-continued $HOOC(CH_2)_{15}COOH$ (25)

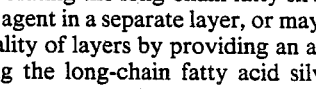
(26)

$HOOC(CH_2)_{16}COOH$ (27)

$HOOC(CH_2)_{17}COOH$ (28)

$HOOC(CH_2)_{18}COOH$ (29)

$HOOC(CH_2)_{19}COOH$ (30)

$HOOC(CH_2)_{20}COOH$ (31)

$HOOC(CH_2)_{21}COOH$ (32)

$HOOC(CH_2)_{22}COOH$ (33)

$HOOC(CH_2)_{23}COOH$ (34)

$HOOC(CH_2)_{24}COOH$ (35)

$HOOC(CH_2)_{28}COOH$ (36)

$HOOC(CH_2)_{32}COOH.$ (37)

The method and timing of adding the compound of this invention are not particularly limited and, for example, a method in which the compound dissolved in a suitable solvent is added directly to a heat-developable photosensitive coating solution, a method in which the compound is added to a layer adjacent to the heat-developable photosensitive material layer, or a method in which a heat-developable photosensitive material coating solution is applied to a support and dried before the surface is subjected to a soaking treatment with a solution containing the compound of this invention can be adopted. The preferred range of the amount of the compound of the invention is 0.001 to 4 mol, more preferably 0.1 to 2 mol per mol of the reducible organosilver salt. More than the necessary amount is not desirable because the maximum density is lowered. The heat-developable photosensitive element to be used in this invention comprises at least (a) an oxidation-reduction image-forming component comprises a long-chain fatty acid silver salt and a reducing agent, (b) a photosensitive silver halide or/and a photosensitive silver halide-forming component, and (c) a binder, though these components can be incorporated in a single layer, they may be distributed to a plurality of layers by incorporating the long-chain fatty silver salt and the reducing agent in a separate layer, or may be distributed to a plurality of layers by providing an additional layer containing the long-chain fatty acid silver salt or the reducing agent on or beneath the above single layer. The long-chain fatty acid silver salts of component (a) are preferably those having 12 to 24 carbon atoms because they difficultly undergo favorable changes such as darkening under the light of a room. Examples of these include silver behenate, silver stearate, silver palmitate, silver myristate, silver laurate, silver oleate, and silver hydroxystearate, among which silver behenate is the most effective.

The reducing agents being used in the oxidation-reduction image-forming component include a variety of compounds. In general, developing agents commonly used in the silver halide photosensitive materials can be mentioned, and more particularly, for example, hydroquinone, methylhydroquinone, chlorohydroquinone, methylhydroxynaphthalene, N,N'-diethyl-p-phenylenediamine, aminophenol, ascorbic acid, and 1-phenyl-3-pyrazolidone can be mentioned. In addition, mention can be made of, for example, 2,2'-methylenebis(6-t-butyl-3-methylphenol), 4,4'-butylidenebis(6-t-butyl-3-methylphenol), 4,4'-thiobis(6-t-butyl-3-methylphenol), and the bisnaphthol reducible compounds described in Japanese Patent Laid-Open No. 6074/1971, and the 4-benzenesulfonamidophenol compounds described in Belgian Pat. No. 802519.

In order to impart photosensitivity, it is necessary to add a silver halide such as silver chloride, silver bromide, silver iodide, silver iodobromide, silver iodochloride, or silver iodochlorobromide to this heat-developable photosensitive element. As the silver halides, those of fine-grain form are particularly effective, and these are prepared, for example, by the following processes: a process in which a finely divided silver halide is prepared by halogenating part of a reducible organosilver salt with a silver halide-forming component such as ammonium bromide, lithium bromide, sodium chloride, or N-bromosuccinimide. It is also possible to use a process in which the so-called ex-site silver halide is added.

A heat-developable photosensitive element containing this ex-site silver halide is described, for example, in Belgian Pat. No. 774436. Namely, the heat-developable photosensitive element is prepared by preparing a photosensitive silver halide somewhere else, i.e., outside the oxidation-reduction image-forming component and then adding this silver halide to the above image-forming compund under agitation. The desirable component of the silver halide or a silver halide-forming component is preferably 0.001 to 0.03 mol, more preferably 0.01 to 0.15 mol per mol of the reducible organosilver salt.

The heat-developable photosensitive material according to this invention may contain a binder alone or in combination in a layer. A suitable material for the binder may be hydrophobic or hydrophilic, and may be transparent or translucent. Examples of the binders include polyvinyl butyrall, cellulose acetate butyrate, polymethyl methacrylate, polyvinylpyrrolidone, ethylcellulose, cellulose acetate, polyvinyl acetate, polyvinyl alcohol, gelatin, and a compound having sulfobetaine repeating units described in Canadian Pat. No. 774054. The amount of the binder used in preferably within the range of from 10:1 to 1:10, more suitably within the range of from 4:1 to 1:2 by weight with respect to the reducible organosilver salt.

In order to improve the tone of an image and the stability after image formation, it is preferred that the heat-developable photosensitive material according to this invention contains an organic acid, and it is also desirable to add this acid which is the same as or similar, in the number of carbon atoms, to the long-chain fatty acid of the long-chain fatty acid silver salt. It is preferable that the amount of the fatty acid used is 25 to 200 molar %, suitably 30 to 120 molar %, based on the reducible organosilver salt.

The heat-developable photosensitive material according to this invention may contain a suitable toning agent. The toning agents for this purpose include, for example, phthalazinones and derivatives thereof described in U.S. Pat. No. 3080254, cyclic imides described in Japanese Patent Laid-Open No. 6074/1971 and phthalazinedione compounds described in Japanese Patent Laid-Open No. 32927/1975.

The heat-developable photosensitive element of this invention may be used in conjunction with a thermal fogging preventive other than that of this invention. Examples of such a preventive include, for example, mercury compounds described in Japanese Patent Publication No. 11113/1972, 1,2,4-triazole compounds described in Japanese Patent Publication No. 42375/1980, tetrazole compounds described in Japanese Patent Laid-Open No. 30 828/1982, benzoic acids described in Japanese Patent Laid-Open No. 138 630/1982, and sulfonylthio group-containing compounds described in Japanese Patent Laid-Open No. 147 627/1982.

The heat-developable photosensitive element of this invention may further contain development accelerator, hardener, antistatic agent (layer), ultraviolet ray absorber, brightening agent, filter dye (layer), and the like.

The element according to this invention may contain a suitable spectral sensitizer. The useful sensitizing dyes include cyanine dyes, merocyanine dyes, xanthene dyes, and particularly those described in the "Product Licensing Index" Vol. 92, pp 107–110 (issued December 1971) or those described in Belgian Pat. No. 772371.

The heat-developable photosensitive element according to this invention may be applied to a suitable support to form a heat-developable photosensitive material. Examples of the typical supports include synthetic resin films or papers such as polyethylene, polpropylene, polyethylene terephthalate, polycarbonate, and cellulose acetate, papers coated with a resin film such as polyethylene, papers such as art paper and baryta paper, metal sheets (foils) such as aluminum, synthetic resin films having a film metallized by the usual method, and glass plates.

This invention will now be described in further detail with reference to examples, but it should be noted that this invention is not limited thereto.

EXAMPLE 1

A dispersion was prepared by dispersing 25 g of silver behenate in 200 ml of xylene and 200 ml of n-butanol by means of a homomixer. 10 g of polyvinyl butyral was added to this dispersion and dissolved with stirring, and the mixture was heated to 65° C. Then, 1.0 g of N-bromosuccinimide dissolved in 25 ml of acetone was added, and the resulting mixture was stirred for 2 hours. Then, 20 g of behenic acid was added and dissolved with stirring, and the resulting dispersion was adjusted to a temperature of 30° C. The following components were added thereto successively with stirring to obtain a first coating solution:

1. 250 ml of a solution of 8% by weight of 2,2'-methylenebis(6-t-butyl-4-methylphenol) and 20% by weight of polyvinyl butyral in xylene/n-butanol mixture (1/1 by volume),
2. 6 g of example compound (13) and
3. 10 ml of a 0.1% DMF solution of 3-ethyl-5-[(3-methyl-2-thiazolylidene)ethylidene]rhodanine.

This first coating solution was applied to a photographic baryta paper by means of a roll coater. At this time, the amount of the solution was 11.5 g/m$^2$ when dried. Then, a heat-developable photosensitive material (I) was prepared by recoating the coating formed by the application of the above first coating solution with a second coating solution comprising the following components so that the amount of the solution applied might be 2.5 g/m$^2$ when dried:

| second coating solution | |
|---|---|
| phthaladinone | 25 g |
| cellulose acetate | 50 g |
| acetone | 1,000 ml |

A heat-developable photosensitive material (II) was prepared by the same method as in the preparation of the heat-developable photosensitive material (I) except that example compound (13) was not used. A heat-developable photosensitive material (III) was prepared in the same manner as above except that 20 g of example compound (13) was used instead of 6 g of this compound. A heat-developable photosensitive material (IV) was prepared in the same manner as above except that the amount of example compound (13) was increased to 60 g.

The above samples were exposed to light at 400 lx for 10 seconds by means of an optical wedge (Step tablet No. 2, a product of Kodak) by using a 150 W enlarging tungsten lamp as a light source and then subjected to heat development at temperature levels of 120°, 125°, 130°, 135°, 140° and 145° C. for 5 seconds for each temperature level by means of a heating roller to form images. The maximum densities, fog densities, and relative sensitivities of the obtained images were measured and compared. Table 1 shows the results. The relative sensitivities shown in Table 1 are relative values of a sensitivity measured by taking a point corresponding to a fog density +0.1 as a basis (the sensitivities were measured in the same way also in the following examples) and are represented by taking the sensitivity of the heat-developable photosensitive material (II) at 130° C. as 100.

TABLE 1

| Heat-developable photosensitive material | Image characteristics | Development conditions (5 sec for each level) | | | | | |
|---|---|---|---|---|---|---|---|
| | | 120° C. | 125° C. | 130° C. | 135° C. | 140° C. | 145° C. |
| (I) (this invention) | Maximum density | 1.20 | 1.55 | 1.62 | 1.61 | 1.60 | 1.60 |
| | Fog density | 0.12 | 0.14 | 0.14 | 0.14 | 0.20 | 0.35 |
| | Relative sensitivity | 70 | 90 | 100 | 100 | 100 | 100 |
| (II) (Comparative Example) | Maximum density | 1.15 | 1.50 | 1.60 | 1.60 | 1.60 | 1.60 |
| | Fog density | 0.12 | 0.20 | 0.35 | 0.50 | 1.10 | 1.60 |
| | Relative sensitivity | 70 | 95 | 100 | 130 | / | / |
| (III) (this invention) | Maximum density | 1.00 | 1.45 | 1.55 | 1.57 | 1.55 | 1.52 |
| | Fog density | 0.12 | 0.12 | 0.12 | 0.12 | 0.15 | 0.20 |
| | Relative sensitivity | 70 | 90 | 100 | 100 | 100 | 100 |
| (IV) (this invention) | Maximum density | 0.85 | 1.20 | 1.30 | 1.30 | 1.30 | 1.30 |
| | Fog density | 0.10 | 0.10 | 0.10 | 0.10 | 0.12 | 0.15 |
| | Relative sensitivity | 70 | 90 | 100 | 100 | 100 | 100 |

Table 1 clearly shows that the heat-developable photosensitive material (I) prepared by using the compound (13) according to this invention showed a remarkable anti-fogging effect as compared with the heat-developable photosensitive material (II) containing no compound (13). Moreover, the heat-developable photosensitive materials (III) and (IV) indicate that when the amount of example compound (13) added was increased, an anti-fogging effect could be obtained also at higher development temperatures while the sensitivity loss did not rise although the maximum density was lowered.

EXAMPLE 2

A heat-developable photosensitive material (V) was prepared by using 4.2 g of example compound (2) instead of example compound (13) of the heat-developable photosensitive material (I) in Example 1. A heat-developable photosensitive material (VI) was prepared by using 4.9 g of example compound (5). A heat-developable photosensitive material (VII) was prepared by using 5.3 g of example compound (9). A heat-developable photosensitive material (VIII) was prepared by using 6.7 g of example compound (19). These photosensitive materials were exposed to light according to the description of Example 1 and subjected to heat developable at temperature levels of 125, 130, and 135 for 5 seconds for each temperature level by means of a heating roller to obtain the results as shown in Table 2. For comparison, the heat-developable photosensitive material (II) in Example 1 was used as a comparative example.

TABLE 2

| Heat-developable photosensitive material | Development condition 125° C., 5 sec | | | Development condition 130° C., 5 sec | | | Development condition 135° C., 5 sec | | |
|---|---|---|---|---|---|---|---|---|---|
| | Maximum density | Fog density | Relative sensitivity | Maximum density | Fog density | Relative sensitivity | Maximum density | Fog density | Relative sensitivity |
| (II) (Comparative Example) | 1.50 | 0.20 | 95 | 1.60 | 0.35 | 100 | 1.60 | 0.50 | 130 |
| (V) (this invention) | 1.50 | 0.12 | 90 | 1.55 | 0.12 | 100 | 1.56 | 0.12 | 100 |
| (VI) (this invention) | 1.60 | 0.14 | 95 | 1.65 | 0.14 | 100 | 1.65 | 0.14 | 100 |
| (VII) (this invention) | 1.57 | 0.12 | 100 | 1.58 | 0.12 | 100 | 1.57 | 0.12 | 100 |
| (VIII) (this invention) | 1.60 | 0.14 | 100 | 1.60 | 0.14 | 100 | 1.60 | 0.14 | 100 |

Table 2 clearly shows that heat-developable photosensitive materials having a markedly suppressed fog density could be obtained by using the compound according to this invention.

EXAMPLE 3

A heat-developable photosensitive material (IX) was prepared in the same manner as described in Example 1 except that 5.2 g of lauric acid was added instead of example compound (13). A heat-developable photosensitive material (X) was prepared by adding 52 g of lauric acid. A heat-developable photosensitive material (XI) was prepared by adding 3.2 g of benzoic acid. A heat-developable photosensitive material (XII) was prepared by adding 0.43 g of phthalic acid. A heat-developable material (XII) was prepaed by adding 4.3 g of phthalic acid. A heat-developable photosensitive material (XIV) was prepared by adding 0.025 g of thiouracil. A heat-developable photosensitive material (XV) was prepared by adding 0.25 g of thiouracil. These heat-developable photosensitive materials were exposed to light according to the description of Example 1 and subjected to heat development at temperature levels of 125°, 130°, and 135° C. for 5 seconds for each temperature level by means of a heating roller to form images. The characteristics of the formed images were compared with those of the heat-developable photosensitive material (I) described in Example 1 to obtain the results as shown in Table 3.

TABLE 3

| Heat-developable photosensitive material | Development condition 125° C., 5 sec | | | Development condition 130° C., 5 sec | | | Development condition 135° C., 5 sec | | |
|---|---|---|---|---|---|---|---|---|---|
| | Maximum density | Fog density | Relative sensitivity | Maximum density | Fog density | Relative sensitivity | Maximum density | Fog density | Relative sensitivity |
| (I) (this invention) | 1.55 | 0.14 | 90 | 1.62 | 0.14 | 100 | 1.61 | 0.14 | 100 |
| (IX) (Comparative Example) | 1.60 | 0.20 | 95 | 1.65 | 0.40 | 100 | 1.65 | 0.65 | 120 |
| (X) (Comparative Example) | 1.65 | 0.25 | 100 | 1.70 | 0.50 | 110 | 1.70 | 0.85 | 140 |
| (XI) (Comparative Example) | 1.60 | 0.20 | 90 | 1.65 | 0.45 | 110 | 1.65 | 0.70 | 130 |
| (XII) (Comparative Example) | 1.50 | 0.18 | 30 | 1.60 | 0.30 | 35 | 1.60 | 0.45 | 40 |
| (XIII) (Comparative Example) | 1.30 | 0.16 | 10 | 1.45 | 0.20 | 12 | 1.45 | 0.35 | 15 |
| (XIV) (Comparative Example) | 1.60 | 0.18 | 30 | 1.60 | 0.30 | 35 | 1.60 | 0.40 | 40 |
| (XV) (Comparative Example) | 1.30 | 0.16 | 10 | 1.35 | 0.20 | 10 | 1.35 | 0.30 | 12 |

Table 3 shows that none of the heat-developable photosensitive materials (IX) and (X) prepared by using lauric acid instead of example compound (13) and the heat-developable photosensitive material (XI) prepared by using benzoic acid instead of example compound (13) have an anti-fogging effect but they show a development-accelerating effect, inversely, and the heat-developable photosensitive materials (XIV) and (XV) prepared by using thiouracil have an anti-fogging effect but have a disadvantage of marked desensitization. As the amount of the compound added was increased, the anti-fogging effect of the materials could be increased, but the loss of sensitivity became marked. The heat-developable photosensitive materials (I) and (IX) to (XV), after image formation, were exposed to room light (white fluorescent lamp, 3000 lx) for 120 hours, and the degree to which the non-image area was colored by light was observed. The heat-developable photosensitive material (I) according to this invention scarcely underwent light discoloration, while all the other photosensitive materials used as comparatives were discolored to pink, and especially, the heat-developable photosensitive materials (XIII) and (XV) showed marked light discoloration.

EXAMPLE 4

A heat-developable photosensitive material (XVI) was prepared in the same manner as in Example 1 except that 200 mg of mercuric acetate was used instead of example compound (13). A heat-developable photosensitive material (XVII) was prepared by adding 2 mg of mercuric acetate. A heat-developable photosensitive material (XVIII) was prepared by adding 2 mg of mercuric acetate together with 4.9 g of example compound (5). These photosensitive materials were exposed to light according to the description of Example 1 and then subjected to heat development at temperature levels of 120°, 130°, 140°, 150° and 160° C. for 5 seconds for each temperature level by means of a heating roller to obtain the results as shown in Table 4. Further, these samples were stored under conditions including a temperature of 35° C. and a relative humidity of 80% for 5 days and then exposed to light in the same manner as above and subjected to heat development at temperature levels of 130° and 150° C. for 5 seconds for each temperature level to obtain the results shown in Table 5.

TABLE 4

| Heat-developable photosensitive material | Image characteristics | Development conditions (5 sec for each) | | | | |
|---|---|---|---|---|---|---|
| | | 120° C. | 130° C. | 140° C. | 150° C. | 160° C. |
| (XVI) (Comparative | Maximum density | 1.20 | 1.70 | 1.72 | 1.70 | 1.70 |
| | Fog density | 0.12 | 0.12 | 0.16 | 0.32 | 0.70 |

TABLE 4-continued

| Heat-developable photosensitive material | Image characteristics | Development conditions (5 sec for each) 120° C. | 130° C. | 140° C. | 150° C. | 160° C. |
|---|---|---|---|---|---|---|
| Example) | Relative sensitivity | 30 | 40 | 42 | 50 | 55 |
| (XVII) | Maximum density | 1.20 | 1.60 | 1.60 | 1.62 | 1.60 |
| (Comparative | Fog density | 0.12 | 0.14 | 0.45 | 1.40 | 1.65 |
| Example) | Relative sensitivity | 70 | 80 | 100 | / | / |
| (XVIII) | Maximum density | 1.20 | 1.60 | 1.65 | 1.65 | 1.65 |
| (this invention) | Fog density | 0.12 | 0.12 | 0.12 | 0.12 | 0.14 |
| | Relative sensitivity | 70 | 100 | 100 | 110 | 115 |

TABLE 5

| Heat-developable photosensitive material | Development condition 130° C., 5 sec Maximum density | Fog density | Relative sensitivity | Development condition 150° C., 5 sec Maximum density | Fog density | Relative sensitivity |
|---|---|---|---|---|---|---|
| (XVI) (Comparative Example) | 1.65 | 0.12 | 10 | 1.65 | 0.30 | 15 |
| (XVII) (Comparative Example) | 1.50 | 0.14 | 70 | 1.55 | 1.20 | / |
| (XVIII) (this invention) | 1.60 | 0.12 | 90 | 1.62 | 0.12 | 100 |

Tables 4 and 5 show that the mercury compounds showed an anti-fogging effect during development according to their amounts, but that when the amounts were excessively large, there was a disadvantage that remarkable desensitization arose with the lapse of time. Further, the heat-developable photosensitive material (XVIII) indicates that when the compound according to this invention was used in conjunction with a minute amount of the mercury compound, its thermal fogging preventing effect was heightened synergistically and the compound exhibited its effect over a wide range of development temperatures. Table 5 shows that a trace amount of the mercury compound used in conjunction at this time was sufficient and that the sensitivity loss with the lapse of time was extremely low.

EXAMPLE 5

A dispersion was prepared by dispersing 25 g of silver behenate and 20 g of behenic acid in 325 ml of xylene and 325 ml of n-butanol by means of a homomixer. 40 g of polyvinyl butyral was added to this dispersion and dissolved with stirring. Then, the dispersion was heated to 50° C., and, after adding 0.25 g of lithium bromide dissolved in 50 ml of methanol, stirred for 2 hours. Then, the mixture was maintained at 30° C. and stirred. To this mixture was added 20 g of 2,2-methylenebis(6-t-butyl-4-methylphenol) and 10 ml of a 0.1% DMF solution of 3-ethyl-5-[(3-methyl-2-thiazolylidene)ethylidene]rhodanine to obtain a first coating solution. This first coating solution was applied to a photographic baryta paper by means of roll coater. At this time, the amount of the solution applied was 9.0 g/m$^2$ when dried. Then, a heat-developable photosensitive material (XIX) was prepared by recoating the coating formed by application of the above first coating solution with a second coating solution comprising the following components so that the amount of the second coating solution applied might be 2.8 g/m$^2$ when dried:

| second coating solution | |
|---|---|
| phthaladinone | 25 g |
| Cellulose acetate | 50 g |
| example compound (8) | 18 g |
| Acetone | 1,000 ml |

Furthermore, a heat-developable photosensitive material (XX) was prepared in the same manner as in the heat-developable photosensitive material (XIX) except that example compound (8) was not used. The above samples were exposed to light according to the description of Example 1, and subjected to heat development at temperature levels of 120°, 125°, and 130° C. for 5 seconds for each temperature level by means of a heating roller to form images. The results are shown in Table 6 were obtained.

TABLE 6

| Heat-developable photosensitive material | Development condition 120° C., 5 sec Maximum density | Fog density | Relative sensitivity | Development condition 125° C., 5 sec Maximum density | Fog density | Relative sensitivity | Development condition 130° C., 5 sec Maximum density | Fog density | Relative sensitivity |
|---|---|---|---|---|---|---|---|---|---|
| (XIX) (this invention) | 1.45 | 0.14 | 60 | 1.50 | 0.14 | 80 | 1.50 | 0.14 | 80 |
| (XX) (Comparative Example) | 1.35 | 0.18 | 60 | 1.45 | 0.25 | 90 | 1.50 | 0.50 | 100 |

Table 6 shows that images having a markedly suppressed fog density could be obtained by adding the compounds according to the invention.

EXAMPLE 6

3.9 g of silver stearate was dispersed in 100 ml of isopropyl alcohol by means of a homomixer. 3 g of polyvinyl butyral was added to this dispersion and dissolved with stirring to form a polymer-suspended dispersion of a silver salt. This dispersion was heated to 50° C. under red safelight. To this was added dropwise under stirring over a period of one hour 0.9 g of lithium bromide dissolved in 30 ml of acetone. After completion of the addition, agitation was continued for 2 hours while the reaction temperature was maintained constant. Then, the temperature of the dispersion was lowered to room temperature to obtain a dispersion of photosensitive silver halide.

Separately, 5 g of silver behenate and 4 g of behenic acid were added to a dispersing medium containing 44 ml of xylene and 44 ml of n-butanol, and the mixture was mixed in a homomixer to form a dispersion. To this was further added 80 g of polyvinyl butyral as a binder and dissolved with stirring to form a polymer dispersion of the silver salt.

This polymer dispersion was mixed with 10 g of the above described dispersion of photosensitive silver halide. Then, to the thus obtained silver behenate polymer dispersion containing the photosensitive silver halide were added successively the following components to obtain a first coating solution:

a solution of 4 g of 2,2'-methylenebis(6-t-butyl-4-methylphenyl) in 5 ml of xylene and 5 ml of n-butanol, 0.0013 g of 1-carboxymethyl-5-[(3-ethylnaphtho[1,2-d]oxazolin-2-ylidene)ethylidene]-3-allylthiohydantoin, and 0.12 g of example compound (15).

This first coating solution was applied to a photographic baryta paper by means of a roll coater. At this time, the amount of the coating solution applied was 10 g/m$^2$ when dried. Then, a heat-developable photosensitive material (XXI) was prepared by recoating the coating formed by applying the above first coating solution with a second coating solution comprising the following components so that the amount of the solution applied might be 1.5 g/m$^2$ when dried:

| second coating solution | |
|---|---|
| cellulose acetate | 15.0 g |
| phthaladinone | 7.5 g |
| acetone | 300 ml |

Moreover, a heat-developable photosensitive material (XXII) was prepared in the same manner as in the heat-developable photosensitive material (XXI) except that example compound (15) was not used.

The above samples were exposed to light according to the description of Example 1 and subjected to heat development at temperature levels of 125° and 130° C. for 5 seconds for each temperature level by means of a heating roller to form images. The results as shown in Table 7 were obtained.

TABLE 7

| Heat-developable photosensitive material | Development condition 120° C., 5 sec | | | Development condition 125° C., 5 sec | | | Development condition 130° C., 5 sec | | |
|---|---|---|---|---|---|---|---|---|---|
| | Maximum density | Fog density | relative sensitivity | Maximum density | Fog density | Relative sensitivity | Maximum density | Fog density | Relative sensitivity |
| XXI (this invention) | 1.60 | 0.16 | 120 | 1.65 | 0.18 | 150 | 1.65 | 0.18 | 150 |
| XXII (Comparative Example) | 1.55 | 0.23 | 120 | 1.60 | 0.38 | 160 | 1.60 | 0.55 | 180 |

Table 7 shows that an image having a suppressed fog density could be obtained by adding the compound according to this invention.

What is claimed is:

1. In a heat-developable photosensitive material prepared by forming, on a support, a single layer or multiple layers of a heat-developable photosensitive element comprising at least (a) an oxidation-reduction image-forming component comprising a long-chain fatty acid silver salt and a reducing agent, (b) a photosensitive silver halide and/or a photosensitive silver halide-forming component, (c) a binder and (d) an antifogging agent, the improvement which comprises: said antifogging agent consists essentially of at least one member selected from the dicarboxylic acid compounds represented by the following general formula:

HOOC—R—COOH wherein R represents an alkylene or alkenylene group of at least 4 carbon atoms, which group may be liner or branched, and the amount of said anitfogging agent (d) is from 0.1 mol to 2 mols per mol of said long-chain fatty acid silver salt.

2. A heat-developable photosensitive material as defined in claim 1, wherein the antifogging agent (d) consists of at least one member selected from the group consisting of adipic acid, pimelic acid, suberic acid, azelaic acid, sebacic acid, undecanedioic acid, and 1,12-dodecanedioic acid.

3. A heat-developable photosensitive material as defined in claim 1, which further comprises a fatty acid which is the same as or similar, in the number of carbon atoms, to the fatty acid which constitutes the long-chain fatty acid silver salt (a).

4. A heat-developable photosensitive material as defined in claim 1, which further comprises a toning agent.

5. A heat-developable photosensitive material as defined in claim 1, which further comprises a spectral sensitizing dye.

6. A heat-developable photosensitive material as defined in claim 1, wherein said long-chain fatty acid silver salt is a silver salt of a long-chain fatty acid having at least 14 carbon atoms.

7. A heat-developable photosensitive material as defined in claim 1, wherein said long-chain fatty acid silver salt is silver behenate.

8. A heat-developable photosensitive material as defined in claim 1 in which R is —$(CH_2)_7$—.

9. In a heat-developable photosensitive material prepared by forming, on a support, a single layer or multiple layers of a heat-developable photosensitive element comprising at least (a) an oxidation-reduction image-forming component comprising a long-chain fatty acid silver salt and a reducing agent, (b) a photosensitive silver halide and/or a photosensitive silver halide-forming component, (c) a binder and (d) an antifogging agent, the improvement which comprises: said antifogging agent consists essentially of a compound supplying mercury ions and at least one member selected from the dicarboxylic acid compounds represented by the following general formula:

HOOC—R—COOH wherein R represents an alkylene or alkenylene group of at least 4 carbon atoms, which group may be linear or branched, and the amount of said dicarboxylic acid compound is from 0.1 to 2 mols per mol of said long-chain fatty acid silver salt.

10. A heat-developable photosensitive material as defined in claim 9, wherein the antifogging agent (d) consists of said compound supplying mercury ions and at least one dicarboxylic acid selected from the group consisting of adipic acid, pimelic acid, suberic acid, azelaic acid, sebacic acid, undecanedioic acid, and 1,12-dodecanedioic acid.

11. A heat-developable photosensitive material as defined in claim 9 in which R is $—(CH_2)_7—$.

* * * * *